US006402133B1

(12) United States Patent
Miyake

(10) Patent No.: US 6,402,133 B1
(45) Date of Patent: Jun. 11, 2002

(54) SHEET CONVEYING APPARATUS AND IMAGE FORMING APPARATUS HAVING THE SAME

(75) Inventor: Hiroaki Miyake, Moriya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/493,229

(22) Filed: Jan. 28, 2000

(30) Foreign Application Priority Data

Feb. 1, 1999 (JP) ..... 11-024404

(51) Int. Cl.[7] ..... B65H 85/00

(52) U.S. Cl. ..... 271/3.19; 271/265.01; 271/265.02; 271/270; 271/291; 271/301; 271/186

(58) Field of Search ..... 271/3.14, 3.18, 271/225, 265.01, 265.02, 270, 291, 301, 303, 184, 186; 399/401

(56) References Cited

U.S. PATENT DOCUMENTS 4,234,305 A 11/1980 Miyake et al. ..... 432/59
5,197,724 A * 3/1993 Kitajima et al. ..... 271/186
5,449,166 A * 9/1995 Lohmann et al. ..... 271/225
5,570,877 A * 11/1996 Asami et al. ..... 271/186
5,572,308 A * 11/1996 Suda et al. ..... 271/303
5,689,795 A * 11/1997 Mastrandrea ..... 399/401
5,775,686 A 7/1998 Miyake ..... 271/127
6,186,497 B1 * 2/2001 Johnston ..... 271/186

* cited by examiner

*Primary Examiner*—H. Grant Skaggs
(74) *Attorney, Agent, or Firm*—Fitzpatrick, Cella, Harper & Scinto

(57) ABSTRACT

A sheet conveying apparatus includes a sheet constant speed conveying device for conveying a sheet at a predetermined speed, a sheet conveying path for guiding the sheet being conveyed by the sheet constant speed conveying device, a sheet reverse feeding rotary member pair capable of forwardly rotating to convey the sheet toward a downstream side and then reversely rotating to send the sheet reversely, a surface reverse conveying path branched from the sheet conveying path and adapted to guide the sheet reversely fed by the sheet reverse feeding rotary member pair, a trailing end detecting sensor disposed between the sheet constant speed conveying device and the sheet reverse feeding rotary member pair and adapted to detect a trailing end of the sheet conveyed through the sheet conveying path, and a control device for controlling rotation of the sheet reverse feeding rotary member pair in such a manner that the sheet can be conveyed at a higher speed than the predetermined speed when the trailing end of the sheet is detected by the trailing end detecting sensor.

8 Claims, 10 Drawing Sheets

SHEET CONVEYING APPARATUS AND IMAGE FORMING APPARATUS HAVING THE SAME

BACKGROUND OF THE INVENTION

1. Field of the Invention

The present invention relates to a sheet conveying apparatus for conveying a sheet and an image forming apparatus having such a sheet conveying apparatus.

2. Related Background Art

In the past, many sheet conveying apparatus have been incorporated, for example, in a main body of an image forming apparatus.

As shown in FIG. 10, such a sheet conveying apparatus is designed so that a (one-sided copying) sheet having one surface on which an image is formed by image forming means of an image forming apparatus (not shown) is discharged outside as it is or is reversed and then is discharged or is reversed and then is sent to the image forming means again in order to form an image on the other surface of the sheet (two-sided copying).

Now, an operation of a conventional sheet conveying apparatus 100 will be explained.

(Face-up sheet discharging mode in one-sided copying)

In the image forming apparatus, a sheet to which a toner image has been fixed is sent to an outer sheet discharge roller pair 27 by an inner sheet discharge roller pair 25 and then is discharged, by the outer sheet discharge roller pair 27, onto a sheet discharge tray (not shown) of a main body 101 of the image forming apparatus with its image bearing surface facing upwardly. In this case, a flapper 26 disposed at a branched portion is switched to a position shown by the solid line.

(Face-down sheet discharging mode in one-sided copying)

By switching the flapper 26 to a position shown by the broken line, the sheet sent from the inner sheet discharge roller pair 25 is conveyed toward a conveying path 66 and then is sent in a direction indicated by the arrow A by a sheet discharge reverse roller pair 59. At a time when a trailing end of the sheet reaches in a range $L_a$, the sheet discharge reverse roller pair 59 reversely rotates to send the sheet to the outer sheet discharge roller pair 27. Then, the sheet is discharged, by the outer sheet discharge roller pair 27, onto the sheet discharge tray (not shown) of the main body 101 of the image forming apparatus with its image bearing surface facing downwardly.

(Two-sided copying mode)

Similar to the face-down sheet discharging mode, by switching the flapper 26 to the position shown by the broken line, the sheet sent from the inner sheet discharge roller pair 25 is conveyed toward the conveying path 66 and then is sent in the direction indicated by the arrow A by the sheet discharge reverse roller pair 59 and a two-sided reverse roller pair 60. At a time when the trailing end of the sheet reaches in a range $L_c$, the two-sided reverse roller pair 60 reversely rotates to sent the sheet to a sheet re-feeding path 50 with its image bearing surface facing upwardly.

By the way, in the two-sided copying mode, a sheet conveying sheet in such a sheet conveying apparatus is selected to be higher than a sheet conveying speed in the image forming apparatus in order to increase the image forming speed.

Now, a method of controlling the sheet conveying speed in this case will be briefly explained.

An inner sheet discharge sensor 62 is disposed downstream of the inner sheet discharge roller pair 25. Fixing means 24 of the image forming apparatus and the inner sheet discharge roller pair 25 are rotated by a common motor M3. The sheet discharge reverse roller pair 59 also having a surface reverse function is rotated by a forward and reverse rotatable and speed-controllable pulse motor M4. Further, the two-sided reverse roller pair 60 also having a surface reverse function is rotated by a forward and reverse rotatable and speed-controllable pulse motor M5.

When a leading end of the sheet is detected by the inner sheet discharge sensor 62, control means (not shown) calculates a time when the trailing end of the sheet surely leaves the inner sheet discharge roller pair 25. At that time, motors M4, M5 are brought to double speed. Thereafter, the two-sided reverse roller pair 60 reversely rotates so that the double speed control is continued until immediately before the sheet abuts against a second registration roller pair (not shown) disposed upstream of the image forming means of the image forming apparatus.

However, in the conventional sheet conveying apparatus 100, the leading end of the sheet is detected by the inner sheet discharge sensor and the control means calculates the time taken till the trailing end of the sheet leaves, thereby determining the speed control and the stop point in the reverse rotation. Therefore, slip in the roller pairs due to change in a sheet surface characteristics caused by change in an environmental condition and sheet delay due to wear of the roller pairs must be taken into consideration.

Thus, the switching to the double speed must be set with some play, thereby the total processing speed in the two-sided copying mode is reduced.

Further, also regarding the reverse position, since the same factors must be taken into consideration, dispersion in the reverse position must be made allowance for. Thus, the excessive length including the dispersion amount and a (dimensions $L_a$, $L_c$ in FIG. 10) must be reserved for the reverse position, thereby making the sheet conveying apparatus and the image forming apparatus having such a sheet conveying apparatus bulky.

SUMMARY OF THE INVENTION

An object of the present invention is to provide a sheet conveying apparatus in which a length required for surface reverse is minimized by optimizing a timing for conveying a sheet at a high speed and by increasing a processing speed in a two-sided copying mode and by reducing dispersion in a reverse position, thereby making the sheet conveying apparatus compact without increasing a manufacturing cost, and an image forming apparatus having such a sheet conveying apparatus.

To achieve the above object, a sheet conveying apparatus according to the present invention comprises sheet constant speed conveying means for conveying a sheet at a predetermined speed, a sheet conveying path for guiding the sheet being conveyed by the sheet constant speed conveying means, a sheet reverse feeding rotary member pair for forwardly rotating to convey the sheet conveyed on the sheet conveying path downstream and then reversely rotating to feed the sheet reversely, a surface reverse conveying path branched from the sheet conveying path and for guiding the sheet reversely fed by the sheet reverse feeding rotary member pair, trailing end detecting means disposed between the sheet constant speed conveying means and the sheet reverse feeding rotary member pair and for detecting a trailing end of the sheet being conveyed on the sheet conveying path, and control means for controlling rotation of the sheet reverse feeding rotary member pair in such a manner that the sheet can be conveyed at a higher speed than the predetermined speed when the trailing end of the sheet is detected by the trailing end detecting means.

In the sheet conveying apparatus, the sheet is conveyed at the predetermined speed on the sheet conveying path by the sheet constant speed conveying means. The sheet is then conveyed by the sheet reverse feeding rotary member pair.

The control means serve to rotate the sheet reverse feeding rotary member pair at a high speed to convey the sheet at the higher speed than the predetermined speed when the trailing end of the sheet being conveyed on the sheet conveying path is detected by the trailing end detecting means. In the sheet conveying apparatus according to the present invention, the control means can store a time period from when the trailing end of the sheet is detected by the trailing end detecting means to when the sheet passes by a branched portion between the sheet conveying path and the surface reverse conveying path. The control means controls the reverse rotation of the sheet reverse feeding rotary member pair on the basis of the time period.

The image forming apparatus according to the present invention comprises the aforementioned sheet conveying apparatus, and image forming means for forming an image on the sheet conveyed by the sheet conveying apparatus.

In the image forming apparatus according to the present invention, the surface reverse conveying path may be a sheet re-feeding path having a re-feeding roller pair, and a downstream end of the sheet re-feeding path may be connected to a sheet feeding path to the image forming means.

The image forming apparatus may be designed so that, after the image is formed on one surface of the sheet by the image forming means, the sheet is conveyed at the high speed on the surface reverse conveying path and surface-reversed, and then, the sheet is conveyed on the re-feeding path by the re-feeding roller pair to be guided into the sheet feeding path, and an image is formed on the other surface of the sheet by the image forming means.

In the image forming apparatus according to the present invention, the re-feeding roller pair may be rotated at a high speed by the control means.

The image forming apparatus may be designed so that, after the image is formed on one surface of the sheet by the image forming means, the sheet is conveyed at the high speed on the surface reverse conveying path and surface-reversed, and then, the sheet is conveyed at a high speed on the re-feeding path by the re-feeding roller pair to be guided into the sheet feeding path, and an image is formed on the other surface of the sheet by the image forming means.

DETAILED DESCRIPTION OF THE PREFERRED EMBODIMENTS

Now, a sheet conveying apparatus 1 according to an embodiment of the present invention and a copying machine 2 as an example of an image forming apparatus having a main body 3 into which the sheet conveying apparatus 1 is incorporated will be explained with reference to the accompanying drawings.

Figure 10:
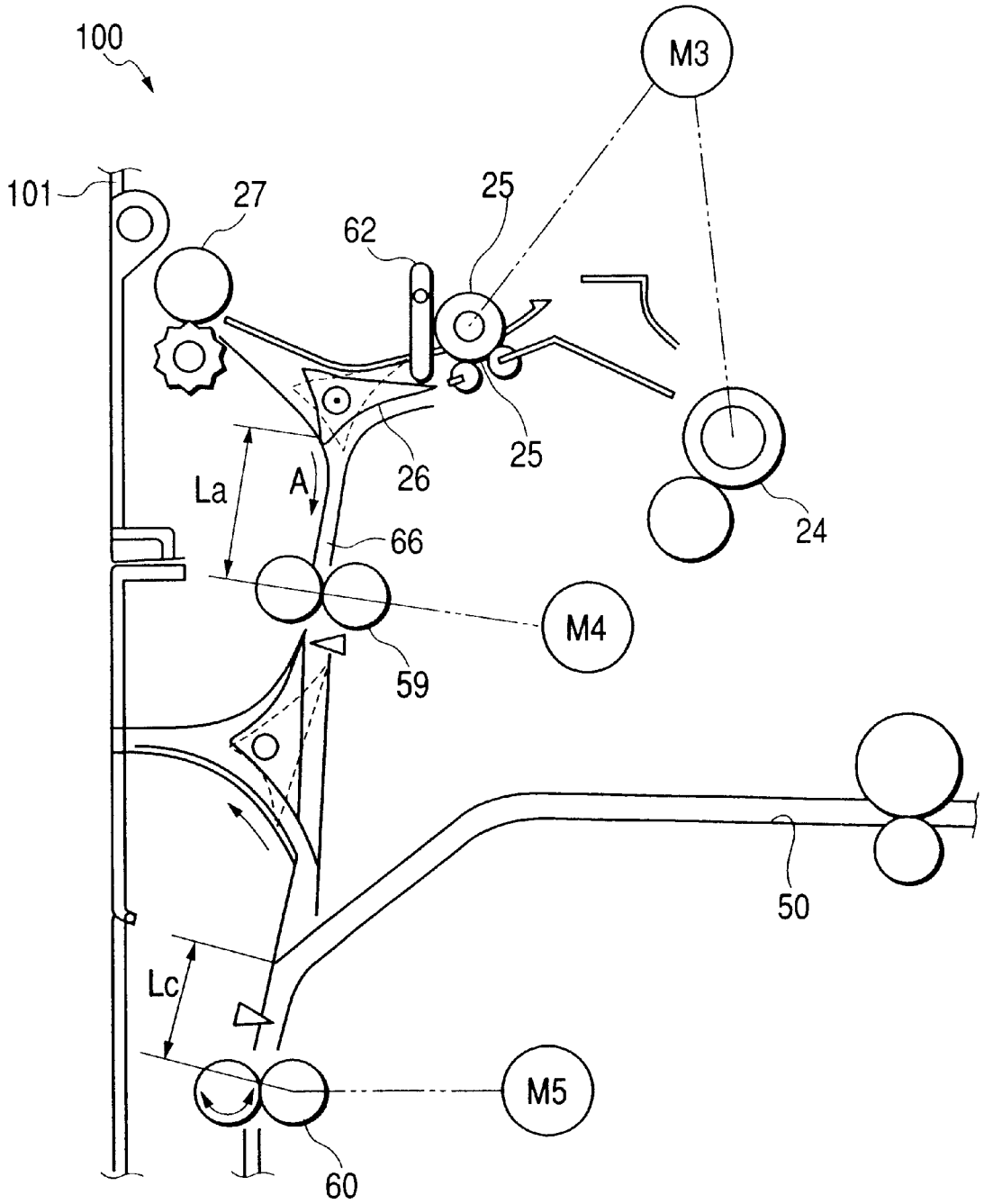
FIG. 10 PRIOR ART
FIG. 10 is a front view showing main parts of a conventional sheet conveying apparatus.

Incidentally, the same elements as those shown in FIG. 10 are designated by the same reference numerals.

Further, the sheet conveying apparatus according to the embodiment of the present invention can be incorporated into a facsimile, a printer or combination thereof, as well as the copying machine and is therefore not limited to incorporation into the main body 3 of the copying machine 2.

In addition, a sheet may include a normal paper, a thin resin sheet (as substitution for the normal paper), a post card, a cardboard, an envelope or a thin plastic plate.

Figure 1:
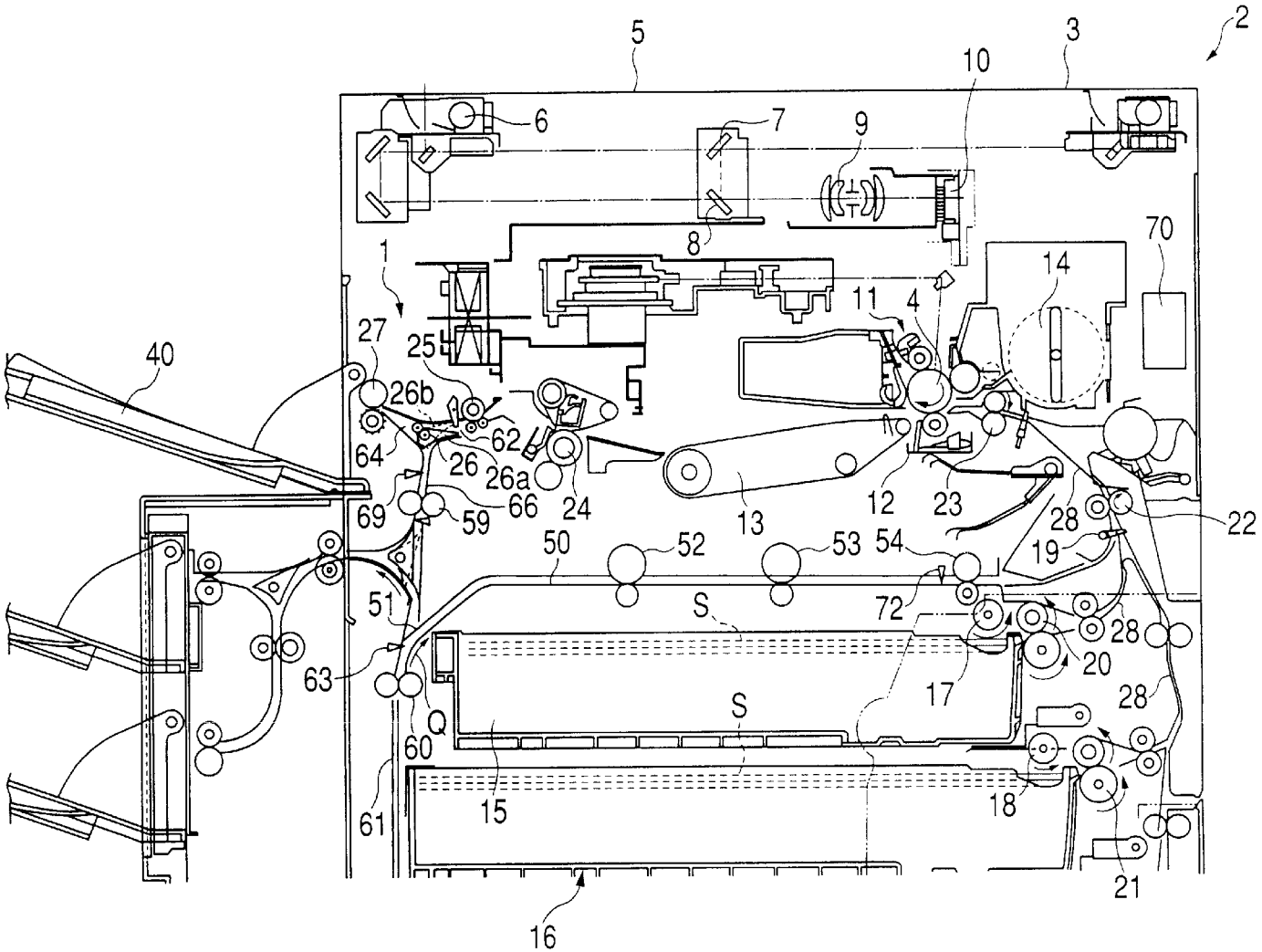
FIG. 1 is a schematic front sectional view of an image forming apparatus of which a main body has a sheet conveying apparatus according to an embodiment of the present invention.

As shown in FIG. 1, the main body 3 of the copying machine 2 is provided with a plurality of sheet feeding cassettes 15, 16. Sheets S contained in these sheet feeding cassettes 15, 16 and having different sizes can selectively be sent to image forming means 11.

Incidentally, the main body 3 of the copying machine also serves as a main body of the sheet conveying apparatus 1.

The sheets S contained in the sheet feeding cassettes 15 or 16 are successively picked up by a pick-up roller 17 or 18 rotated in a direction indicated by the arrow from an uppermost sheet to a sheet feeding path 28. The sheet feeding path 28 serves to guide the sheet from the sheet feeding cassettes 15, 16 to the image forming means 11.

The sheets S picked up by the pick-up roller 17 or 18 are separated one by one by a separation roller pair 20 or 21 rotated in a direction indicated by the arrow, and the separated sheet is fed to a second registration roller pair 22 and a registration roller pair 23 which are now stopped.

When a leading end of the sheet S separated by the separation roller pair 20 or 21 abuts against a nip of the registration roller pair 23, a predetermined lop is formed in the sheet, thereby correcting skew-feed of the sheet.

After the skew-feed of the sheet S is corrected, the sheet S is sent between a photosensitive drum 4 of the image forming means 11 and a transfer charger 12 by the registration roller pair 23 which is rotated in a direction indicated by the arrow at a timing for registering the sheet with a toner image on the photosensitive drum 4 rotated in a direction indicated by the arrow, where the toner image on the photosensitive drum 4 is transferred onto the sheet by the transfer charger 12.

In the copying machine 2, an image on an original rested on a platen glass 5 is read through a CCD (image reading sensor) 10 by an optical system comprising an illumination lamp 6, reflection mirrors 7, 8 and a zoom lens 9, and the read image information is subjected to desired image processing. As a result, a laser beam corresponding to the image information is illuminated on the photosensitive drum 4 through a laser scanner rotated in a direction indicated by the arrow. In this way, an electrostatic latent image is formed on the photosensitive drum 4. The electrostatic latent image is visualized as a toner image by black toner supplied from a developing device 14.

After the toner image has been transferred to the sheet S in the image forming means 11, the sheet S is sent at a predetermined speed, by a conveying belt 13, to fixing means 24, in which the toner image is fixed to the sheet.

(Face-up sheet discharging mode in one-sided copying)

After the toner image has been fixed to the sheet S, the sheet S is sent to an outer sheet discharge roller pair 27 at a predetermined speed by an inner sheet discharge roller pair 25 and then is discharged, by the outer sheet discharge roller pair 27, onto a sheet discharge tray 40 outside of the main body of the copying machine with its image bearing surface facing upwardly. In this case, a flapper 26 disposed at a branched portion is switched to a position 26*a* shown by the solid line in FIG. 2.

(Face-down sheet discharging mode in one-sided copying)

By switching the flapper 26 to a position 26*b* shown by the broken line by a CPU 70, the sheet sent from the inner sheet discharge roller pair 25 is conveyed toward a surface reverse conveying path 66 and then is sent in a direction indicated by the arrow A by a sheet discharge reverse roller pair 59. The sheet discharge reverse roller pair 59 reversely rotates to send the sheet to the outer sheet discharge roller pair 27. Then, the sheet is discharged, by the outer sheet discharge roller pair 27, onto the sheet discharge tray 40 outside of the machine with its image bearing surface facing downwardly.

(Two-sided copying mode)

Similar to the face-down sheet discharging mode, by switching the flapper 26 to the position 26*b* shown by the broken line by the CPU 70, the sheet sent from the inner sheet discharge roller pair 25 is conveyed toward the surface reverse conveying path 66 and then is sent in the direction indicated by the arrow A by the sheet discharge reverse roller pair 59 and a two-sided reverse roller pair 60. At a time when a trailing end of the sheet entered into a surface reverse conveying path 61 reaches in a range $L_c$, the two-sided reverse roller pair 60 reversely rotates to send the sheet to a sheet re-feeding path 50 with its image bearing surface facing upwardly.

Figure 4:
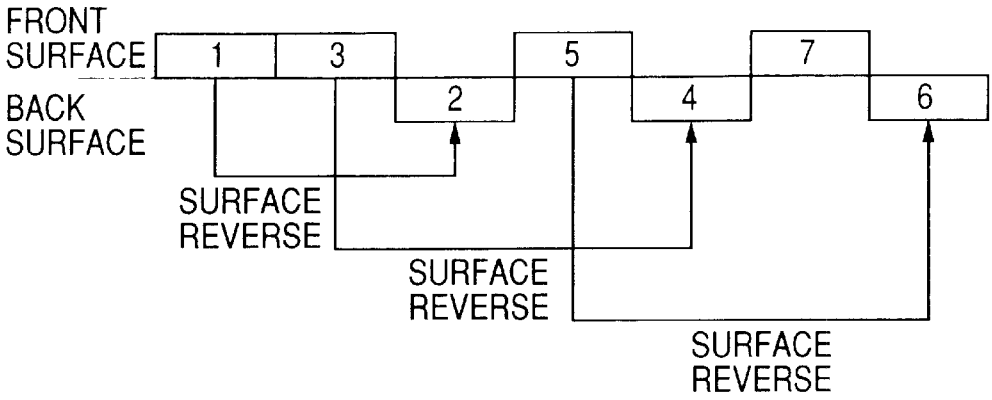
FIG. 4 is a view showing a two-sided image processing pattern.

In the two-sided copying mode, as shown in FIG. 4, front surfaces (first and third pages) of two sheets supplied from the sheet feeding cassette 15 or 16 are firstly subjected to image processing successively, and the surfaces of the first sheet is reversed in the surface reverse conveying path 61 and a back surface (second page) of the first sheet is subjected to the image processing. Thereafter, the front and back surfaces are alternately subjected to the image processing repeatedly. The reason is that the sheets should be kept from stacking in the sheet re-feeding path 50.

Figure 3:
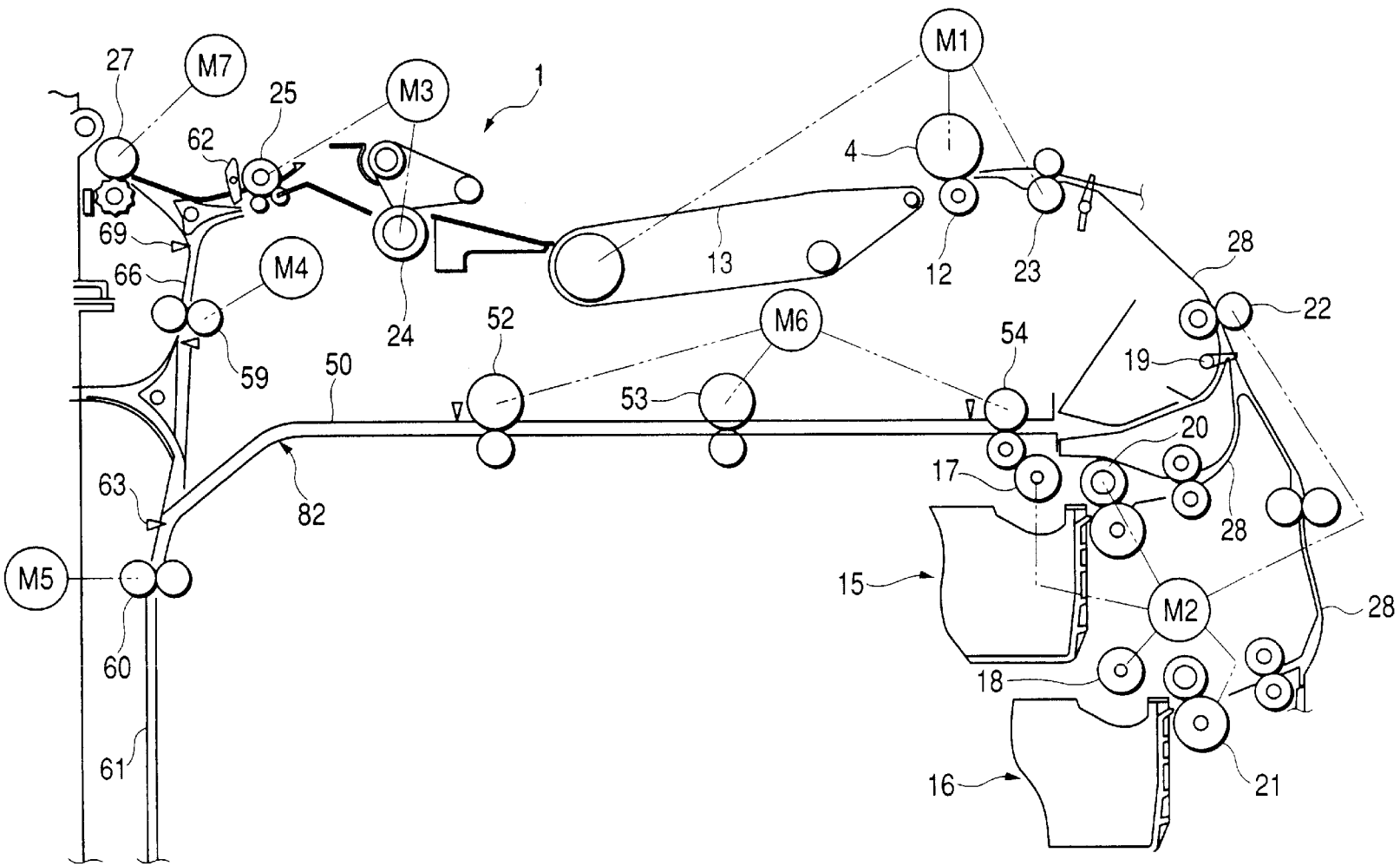
FIG. 3 is a schematic front view of the sheet conveying apparatus.

In the above arrangement, as shown in FIG. 3, main parts which can be rotated are rotated by motors M1, M2, M3, M4, M5, M6 and M7.

That is to say, the photosensitive drum 4, the registration roller pair 23 and the conveying belt 13 are rotated by a main motor M1, the pick-up rollers 17, 18, the separation roller pairs 20, 21 and the second registration roller pair 22 are rotated by a sheet feeding motor M2 comprising a stepping motor, the inner sheet discharge roller pair 25 and the fixing means 24 (as first conveying means) are rotated by a fixing motor M3 comprising a DC motor, the sheet discharge reverse roller pair 59 (as second conveying means) is rotated by a sheet discharge reverse motor M4 comprising a stepping motor, the two-sided reverse roller pair 60 (as second conveying means) is rotated by a two-sided reverse motor M5 comprising a stepping motor, the three sets of re-feeding roller pairs 52, 53, 54 (as third conveying means) disposed in the sheet re-feeding path 50 are rotated by a re-feeding motor M6 comprising a stepping motor, and the outer sheet discharge roller pair 27 is rotated by an outer sheet discharge motor M7 comprising a stepping motor.

Since the sheet discharge reverse roller pair 59, the two-sided reverse roller pair 60 and the re-feeding roller pairs 52, 53, 54, are rotated by the stepping motors, the position of the sheet can easily be determined from rotational directions, rotating speeds and step numbers of these roller pairs.

As sheet detecting sensors, there are provided a second registration sensor 19, an inner sheet discharge sensor 62 and a surface reverse sensor 63.

Figure 5:
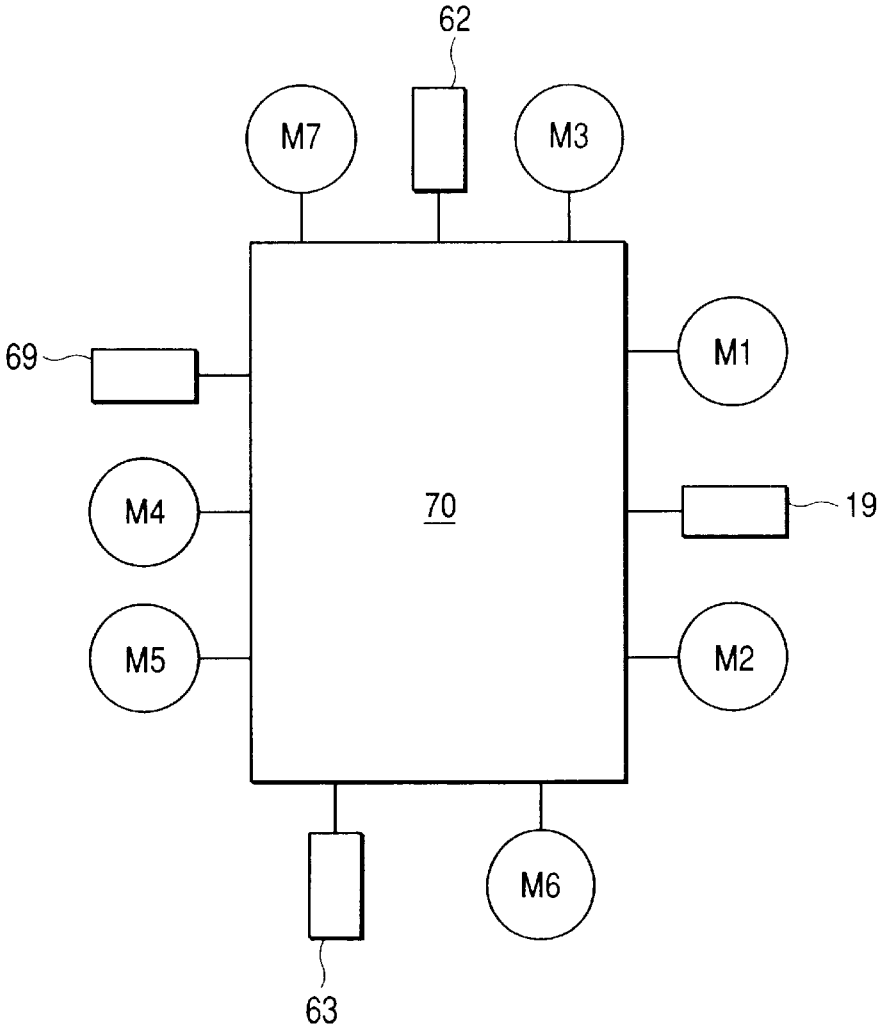
FIG. 5 is a control block diagram of the sheet conveying apparatus.

The above-mentioned motors are controlled by the CPU (control means) 70 shown in FIG. 5 on the basis of sheet detection information obtained by the above sensors.

Next, control of the CPU 70 in the two-sided copying mode, the face-up sheet discharging mode in one-sided copying and the face-down sheet discharging mode in one-sided copying will be explained with reference to a flowchart shown in FIGS. 7A, 7B, 8 and 9.

Figure 7:
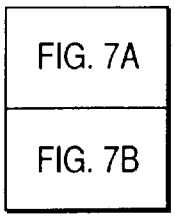
FIG. 7 is comprised of FIGS. 7A and 7B are flowcharts of the sheet conveying apparatus.
Figure 7A:
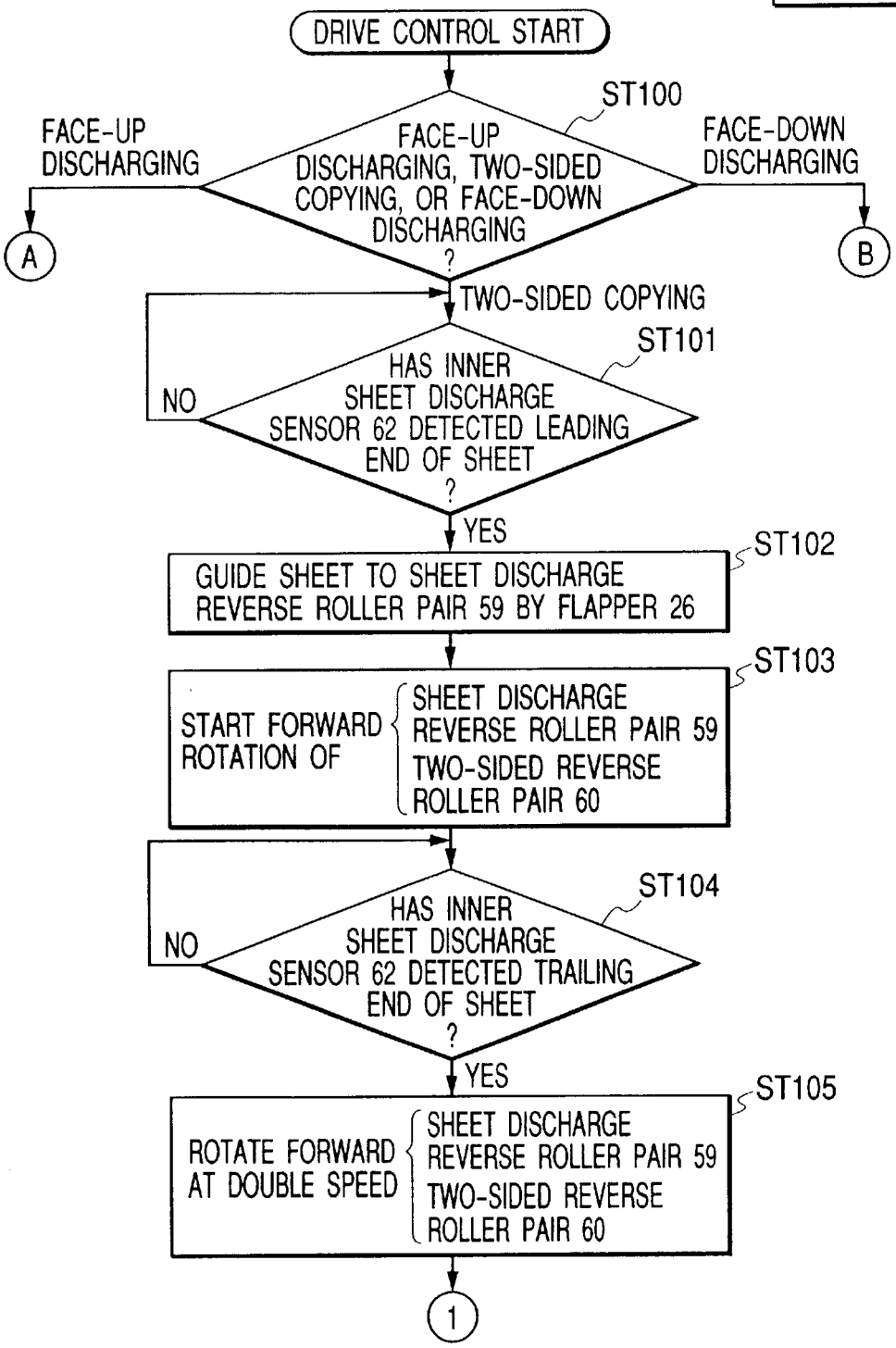
Figure 7B:
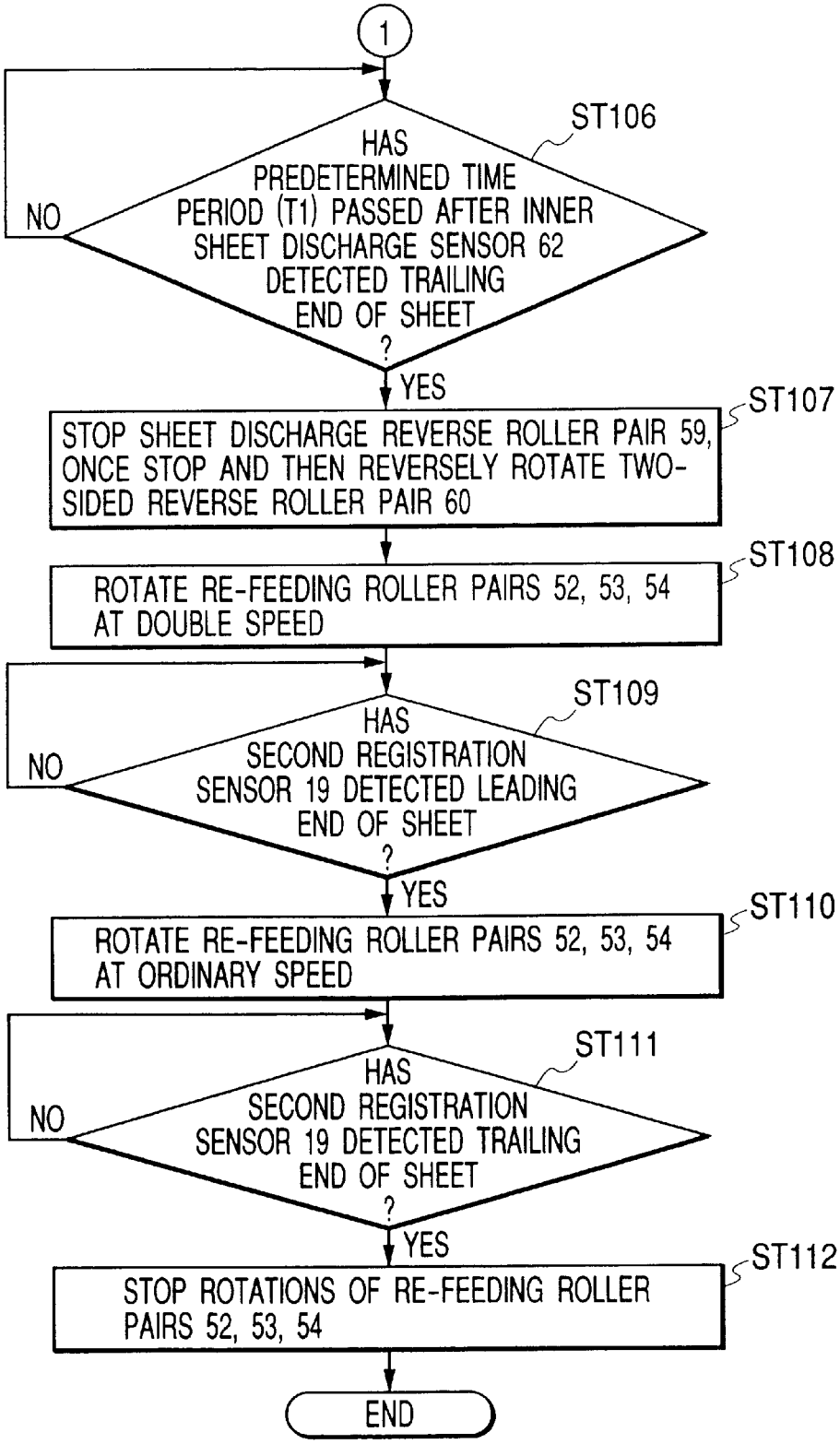

(Two-sided copying mode) Refer to FIGS. 7A and 7B.

The inner sheet discharge sensor 62 and the second registration sensor 19 are provided in the sheet conveying path and the sheet feeding path as sheet detecting and controlling sensors. A signal for commanding the two-sided copying of a sheet having a known size is inputted to the copying machine (step 100; "step" is referred to as "ST" hereinafter). Substantially at the same time when the leading end of the sheet is detected by the inner sheet discharge sensor 62 (ST 101), the CPU 70 switches the flapper 26 to the position 26*b* shown by the broken line (ST 102).

After a predetermined time period is elapsed, the CPU 70 starts to rotate the sheet discharge reverse motor M4 and the two-sided reverse motor M5 (stepping motors) for driving the sheet discharge reverse roller pair 59 and the two-sided reverse roller pair 60, respectively, in a forward direction, thereby conveying the sheet at a predetermined conveying speed (ST 103). At the same time when the trailing end of the sheet is detected by the inner sheet discharge sensor 62 (ST 104), the CPU 70 increases the sheet conveying speed to a double speed greater than the predetermined speed thereby conveying the sheet at a higher speed (ST 105). A time period $T_1$ from when the trailing end of the sheet is detected by the inner sheet discharge sensor 62 to when the sheet reaches the reverse position C is determined by "(distance $L_b$–$L_d$)/(double conveying speed)", and the time period $T_1$ is previously stored in the CPU 70. When the time period $T_1$, is elapsed after the trailing end of the sheet is detected by the inner sheet discharge sensor 62, the CPU 70 rotates the two-sided reverse motor M5 in a reverse direction to rotate the two-sided reverse roller pair 60 reversely. As a result, the sheet is reversed at the reverse position C (ST 106, ST 107). An elastic member (for example, a PET sheet) 51 is adhered, by an adhesive, to one end of an upper guide 50*a* in the sheet re-feeding path 50 so that the elastic member 51 acts as a valve for changing the direction of the sheet to a direction indicated by the arrow Q to guide the sheet into the sheet re-feeding path 50.

By detecting the trailing end of the sheet as is in the illustrated embodiment, unlike to the conventional case in which the leading end of the sheet is detected, it is not required that error in sheet length (due to slip and/or roller wear) be estimated, with the result that not only the speed variable timing can be optimized after the trailing end of the sheet leaves but also dispersion in reverse position can be minimized.

The CPU 70 controls the re-feeding motor M6 to rotate the re-feeding roller pairs 52, 53, 54 at the double speed until the sheet abuts against the second registration roller pair 22, thereby conveying the sheet at a higher speed (ST 108). After the sheet is detected by the second registration sensor 19 (ST 109) and reaches the second registration roller pair 22 and after a loop for correcting the skew-feed is formed on the sheet, and when the sheet is re-started, by returning the rotating speeds of the re-feeding roller pairs 52, 53, 54 to the ordinary predetermined speeds, the print speed can be increased without pulling the sheet (ST 110). When the trailing end of the sheet is detected by the second registration sensor 19 (ST 111), the rotations of the re-feeding roller pairs 52, 53, 54 are stopped (ST 112).

Figure 6:
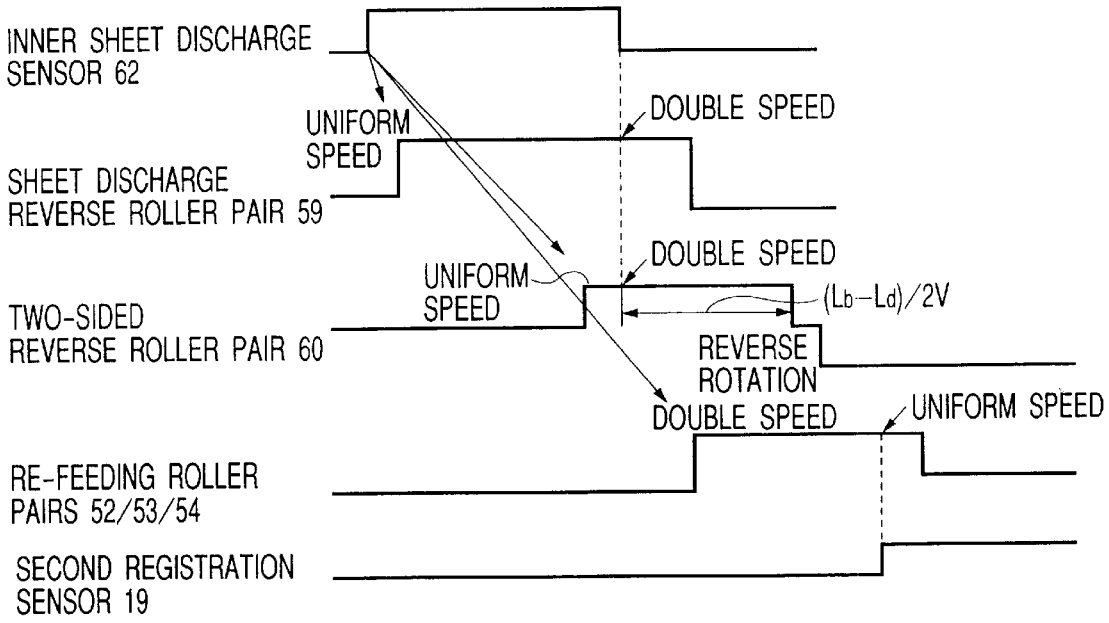
FIG. 6 is an operational timing chart of sensors and roller pairs in the main parts of the sheet conveying apparatus.

FIG. 6 is an operating timing chart for sensors and roller pairs.

(Face-up sheet discharging mode in one-sided copying)

Figure 8:
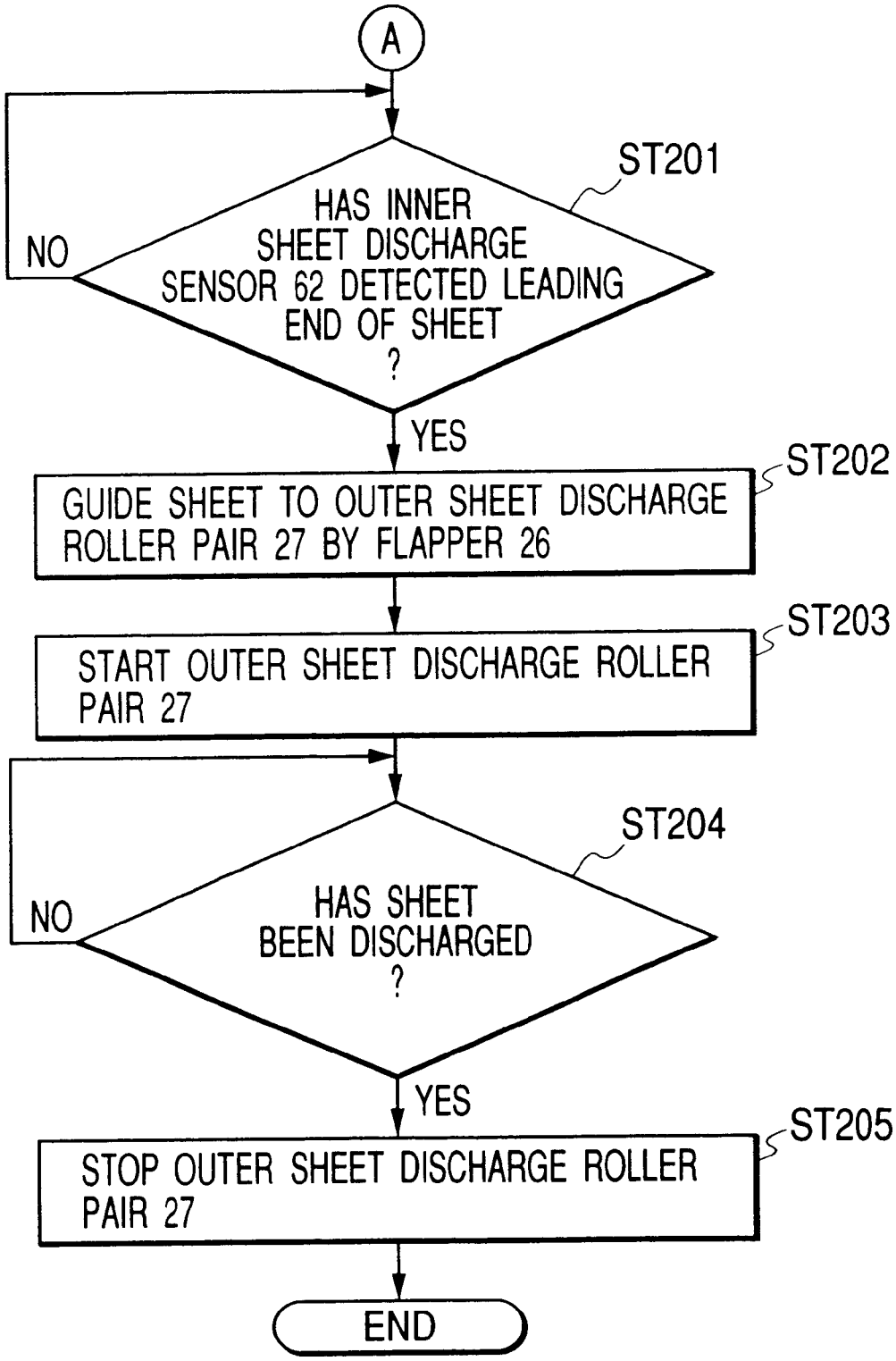
FIGS. 8 and 9 are flowcharts of the sheet conveying apparatus.

Refer to FIG. 8

A signal for commanding the face-up discharging of a sheet having a known size in one-sided copying mode is inputted to the copying machine (ST 100; refer to FIGS. 7A and 7B). When a leading end of the sheet S to which the toner image has been fixed is detected by the inner sheet discharge sensor 62 (ST 201; refer to FIG. 8), the CPU 70 switches the flapper 26 to the position 26*a* shown by the solid line to guide the sheet to the outer sheet discharge roller pair 27 (ST 202). Then, the sheet is discharged, by the outer sheet discharge roller pair 27, onto the sheet discharge tray 40 outside of the main body of the copying machine with its image bearing surface facing upwardly (ST 203, ST 204), and the rotation of the outer sheet discharge roller pair 27 is stopped (ST 205).

(Face-down sheet discharging mode in one-sided copying)

Figure 9:
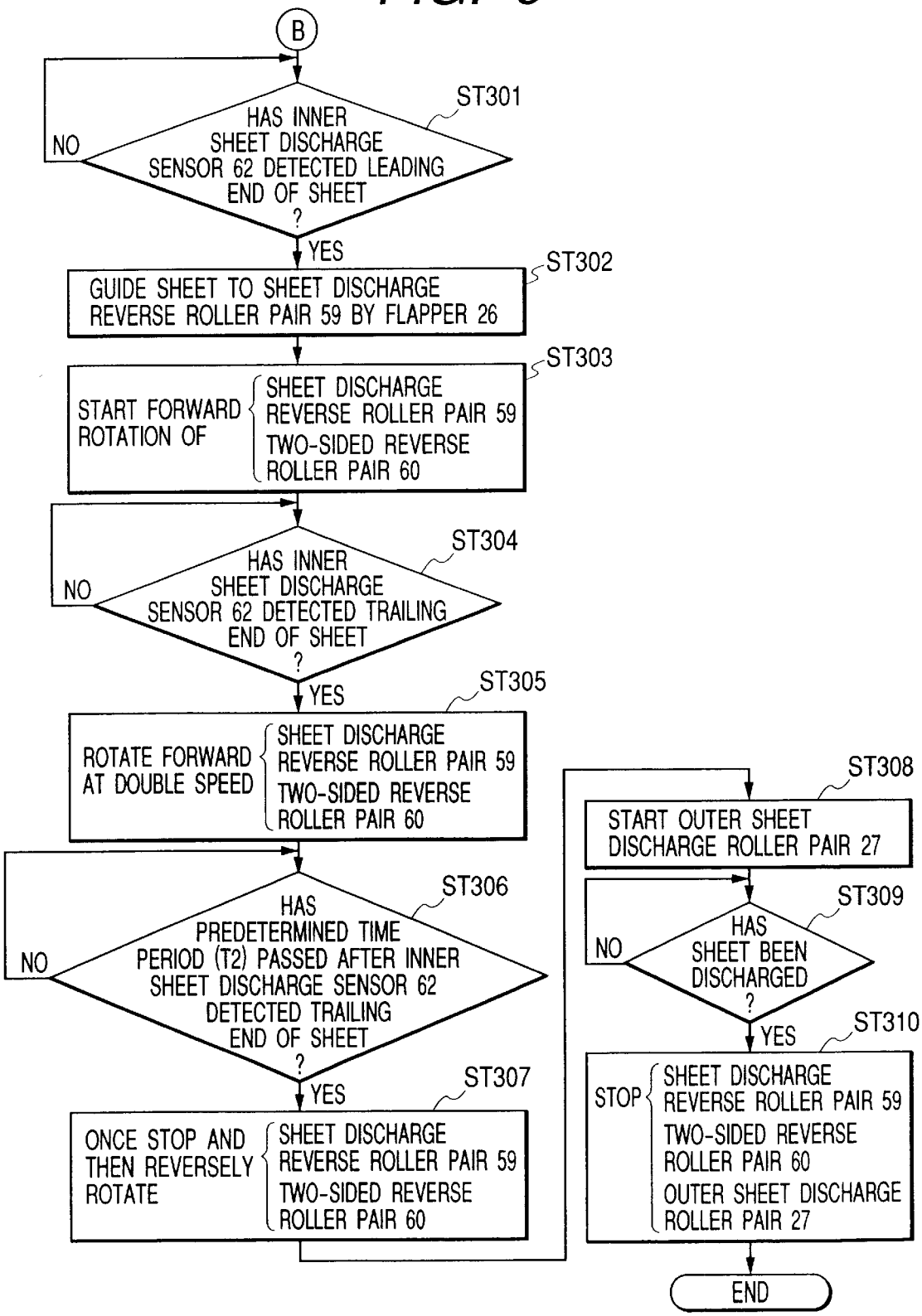

Refer to FIG. 9

A signal for commanding the face-down discharging of a sheet having a known size in one-sided copying mode is inputted to the copying machine (ST 100; refer to FIG. 7). Substantially at the same time when the leading end of the sheet is detected by the inner sheet discharge sensor 62 (ST 301; refer to FIG. 9), the CPU 70 switches the flapper 26 to the position 26*b* shown by the broken line (ST 302).

After a predetermined time period is elapsed, the CPU 70 starts to rotate the sheet discharge reverse motor M4 and the two-sided reverse motor M5 (stepping motors) for driving the sheet discharge reverse roller pair 59 and the two-sided reverse roller pair 60, respectively, in a forward direction, thereby conveying the sheet at a predetermined conveying speed (ST 303). When the trailing end of the sheet is detected by the inner sheet discharge sensor 62 (ST 304), the CPU 70 increases the sheet conveying speed to a double speed, thereby conveying the sheet at a higher speed (ST 305). A time period $T_2$ from when the trailing end of the sheet is detected by the inner sheet discharge sensor 62 to when the sheet reaches the reverse position D is determined by "(distance $L_e$–$L_a$)/(double conveying speed)", and the time period $T_2$ is previously stored in the CPU 70. When the time period $T_2$ is elapsed after the trailing end of the sheet is detected by the inner sheet discharge sensor 62, the CPU 70 rotates the two-sided reverse motor M5 in a reverse direction to rotate the two-sided reverse roller pair 60 reversely. As a result, the sheet is reversed at the reverse position D (ST 306, ST 307).

An elastic member (for example, a PET sheet) 68 is adhered to one end of the flapper 26 so that the elastic member 68 serves as a valve for changing the direction of the sheet toward the outer sheet discharge roller pair 27 to guide the sheet into the sheet reverse discharge path 64.

By detecting the trailing end of the sheet as is in the illustrated embodiment, unlike to the conventional case in which the leading end of the sheet is detected, it is not required that error in sheet length (due to slip and/or roller wear) be estimated, with the result that not only the speed variable timing can be optimized after the trailing end of the sheet leaves but also dispersion in reverse position can be minimized.

The CPU 70 controls the outer sheet discharge motor M7 to start the outer sheet discharge roller pair 27 (ST 308) to discharge the sheet out of the main body 3 (ST 309), and the roller pairs 59, 60, 27 are stopped (ST 310).

Comparing the conventional case in which the double speed control is effected by detecting the leading end of the sheet with the present invention in which the double speed control is effected by detecting the trailing end of the sheet, in the former, the excessive length must be allowed for the dispersion in the feeding amount of the sheet.

Factors must be taken into consideration as the dispersion amounts are initial tolerance of the diameter of the inner sheet discharge roller pair 25, dispersion in feeding amount due to wear of rollers and slip caused during the sheet feeding, and, from the test results, it is found that there is dispersion amount of about 8 mm regarding a sheet having A4 size.

However, when the trailing end of the sheet is detected, the dispersion of about 8 mm can be eliminated, the lengths $L_c$, $L_a$ which must be taken into consideration as the reverse positions can be shortened.

Further, when the double speed timing can be hastened by even about 8 mm, the print speed in the two-sided copying mode can simultaneously increased.

In the illustrated embodiment, while an example that the drive source for two-sided conveyance includes the stepping motors is explained, combination of clutches and one-way clutches may be used. In this case, the peripheral speed of the re-feeding roller pair may be increased to a double speed, so that, so long as the re-feeding roller pair is disenergized from the drive source when the sheet is nipped by the registration roller pair, the registration roller pair draws the sheet without pulling the sheet between the re-feeding roller pair and the registration roller pair.

Further, the conveying speed of the sheet reverse portion and the two-sided portion may be set to any speed greater than the predetermined speed, as well as the double speed.

Figure 2:
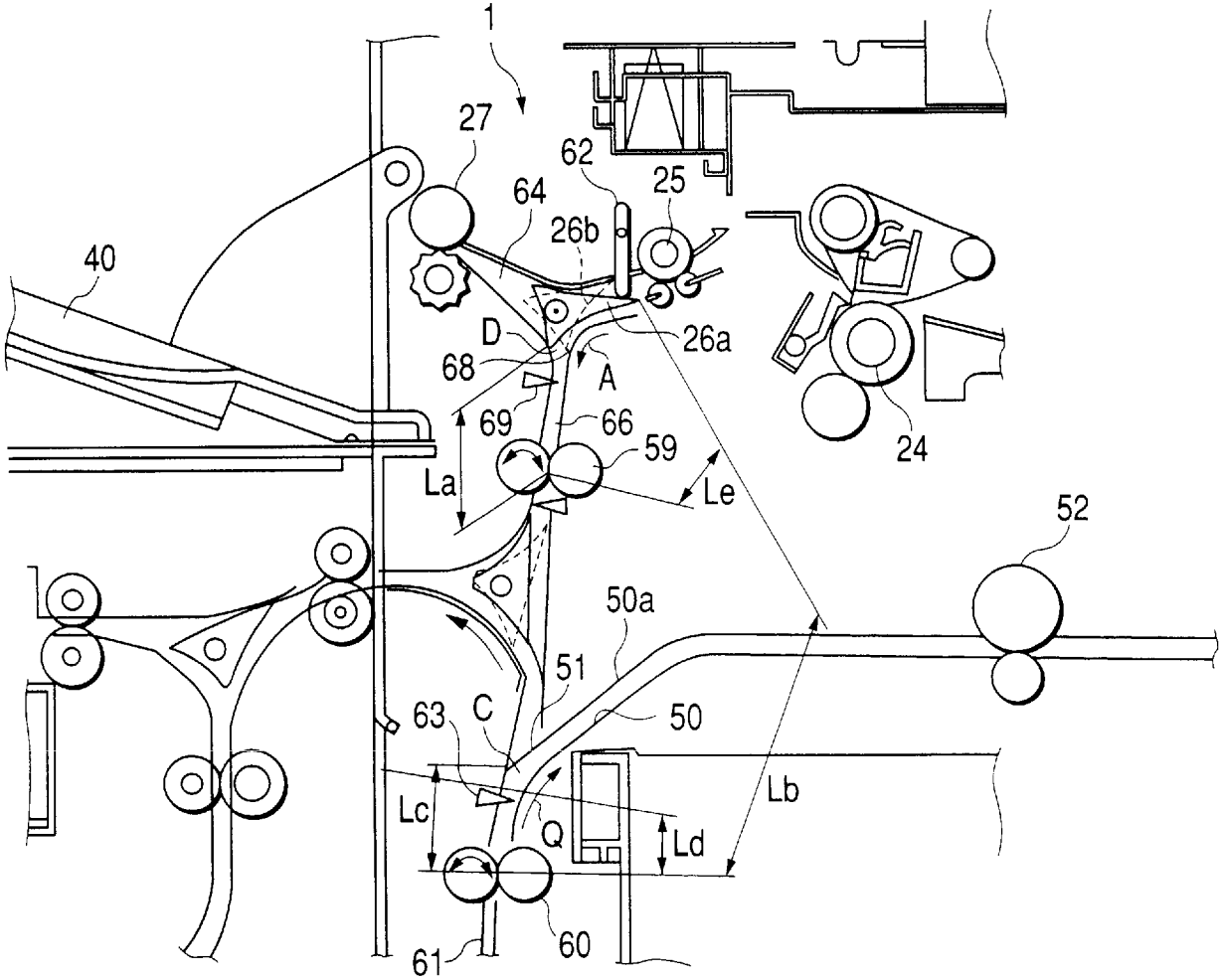
FIG. 2 is a detailed view showing main parts of the sheet conveying apparatus.

Incidentally, in the above-mentioned illustrated embodiment, in the case where the sheet is reversed at the reverse positions C, D, when the predetermined time periods $T_1$, $T_2$ are elapsed after the trailing end of the sheet is detected by the inner sheet discharge sensor 62, the trailing end of the sheet is regarded to reach the reverse positions C, D, and the CPU 70 reverses the sheet. However, as shown in FIG. 2, the surface reverse sensors 63, 69 may be disposed upstream of the two-sided reverse roller pair 60 and the sheet discharge reverse roller pair 59 so that, at the same time when the trailing end of the sheet is detected by the surface reverse sensors 63, 69, so long as the two-sided reverse roller pair 60 and the sheet discharge reverse roller pair 59 are stopped/reversed, the dispersion in the reverse points can be reduced and the copying machine can be made more compact.

In the sheet conveying apparatus according to the present invention, since the trailing end of the sheet is detected and since the sheet is conveyed at the higher speed, the speed variable timing can be optimized after the trailing end of the sheet leaves without estimating error in sheet length (due to slip and/or roller wear), and the acceleration can be timed correctly. Further, since the acceleration is timed correctly, the excessive space including dispersion in acceleration timing is not required accordingly, thereby making the copying machine more compact without increasing any cost.

In the sheet conveying apparatus according to the present invention, when the predetermined time period is elapsed after the trailing end of the sheet is detected by the trailing end detecting means, the trailing end of the sheet is regarded to pass by the branched portion between the sheet conveying path and the surface reverse conveying path, and the control means rotate the sheet reverse feeding rotary member pair in the reverse direction to introduce the sheet into the surface reverse conveying path. Thus, dispersion in sheet reversing can be minimized, in addition to the achieving the above effect. Further, since the dispersion in sheet reversing is minimized, the excessive surface reverse space including the dispersion in sheet reversing is not required accordingly, thereby making the copying machine more compact without increasing any cost.

In the sheet conveying apparatus according to the present invention, when the trailing end of the sheet is detected by the second trailing end detecting means, the control means rotate the sheet reverse feeding rotary member pair in the reverse direction to introduce the sheet into the surface reverse conveying path. Thus, dispersion in sheet reversing can be reduced more effectively, in addition to the achieving the above effect. Further, since the dispersion in sheet reversing is minimized, the excessive surface reverse space including the dispersion in sheet reversing is not required accordingly, thereby making the copying machine more compact without increasing any cost.

Since the image forming apparatus according to the present invention has the sheet conveying apparatus for conveying the sheet correctly and quickly, the image processing ability can be enhanced.

In the image forming apparatus according to the present invention, after the image is formed on one surface of the sheet by the image forming means, the sheet is conveyed at a higher speed on the re-feeding path by the re-feeding roller pair to guide the sheet into the sheet feeding path, and the image is formed on the other surface of the same sheet by the image forming means. Thus, the total time period for forming the images on both surfaces of the sheet can be shortened to enhance the image processing ability.

What is claimed is:

1. A sheet conveying apparatus comprising:

sheet constant speed conveying means for conveying a sheet at a predetermined speed;

a sheet conveying path for guiding the sheet being conveyed by said sheet constant speed conveying means;

a sheet reverse feeding rotary member pair for forwardly rotating to convey the sheet conveyed on said sheet conveying path downstream and then reversely rotating to feed the sheet reversely;

a surface reverse conveying path branched from said sheet conveying path and for guiding the sheet reversely fed by said sheet reverse feeding rotary member pair;

trailing end detecting means disposed between said sheet constant speed conveying means and said sheet reverse feeding rotary member pair and for detecting a trailing end of the sheet being conveyed on said sheet conveying path; and control means for controlling rotation of said sheet reverse feeding rotary member pair in such a manner that the sheet is conveyed at a speed higher than the predetermined speed when the trailing end of the sheet is detected by said trailing end detecting means.

2. A sheet conveying apparatus according to claim 1, wherein said control means stores therein a time period from when the trailing end of the sheet is detected by said trailing end detecting means to when the sheet passes a branched portion between said sheet conveying path and said surface reverse conveying path, and said control means controls reverse rotation of said sheet reverse feeding rotary member pair based on said time period.

3. A sheet conveying apparatus according to claim 1, further comprising second trailing end detecting means for detecting the trailing end of the sheet and disposed between a branched portion between said sheet conveying path and said sheet reverse conveying path and said sheet reverse feeding rotary member pair, wherein, when the trailing end of the sheet is detected by said second trailing end detecting means, said control means controls the reverse rotation of said sheet reverse feeding rotary member pair.

4. A sheet conveying apparatus according to claim 1, wherein said sheet reverse conveying path is a sheet reverse discharge path having a downstream end connected to a sheet discharge tray.

5. A sheet conveying apparatus according to any one of claims 1 to 4, further comprising image forming means for forming an image on the sheet conveyed by said sheet conveying apparatus.

6. A sheet conveying apparatus according to claim 5, wherein said sheet reverse conveying path is a sheet re-feeding path having a re-feeding roller pair, and a downstream end of said sheet re-feeding path is connected to a sheet feeding path to said image forming means.

7. A sheet conveying apparatus according to claim 6, wherein said re-feeding roller pair is rotatable at a high speed by said control means.

8. An image forming apparatus for forming images on both surfaces of a sheet, comprising:

a sheet feeding path for guiding a sheet sent from a supplying portion to an image forming portion;

first conveying means for conveying the sheet on which an image is formed in said image forming portion to a discharging portion at a predetermined speed;

guide means for guiding the sheet conveyed by said first conveying means to a surface reverse conveying path;

second conveying means for conveying the sheet sent to said surface reverse conveying path in forward and reverse directions;

third conveying means for conveying the sheet conveyed by said second conveying means to said sheet feeding path through a re-feeding path;

trailing end detecting means for detecting a trailing end of the sheet sent to said surface reverse conveying path; and speed controlling means for effecting control in such a manner that the sheet is conveyed by said second and third conveying means at a speed higher than the predetermined speed based on a detection of the trailing end of the sheet detected by said trailing end detecting means.

* * * * *

UNITED STATES PATENT AND TRADEMARK OFFICE

CERTIFICATE OF CORRECTION

PATENT NO. : 6,402,133 B1
DATED : June 11, 2002
INVENTOR(S) : Hiroaki Miyake

It is certified that error appears in the above-identified patent and that said Letters Patent is hereby corrected as shown below:

Column 1,
Line 57, "sent" should read -- send --.

Column 2,
Line 34, "a" should read -- α --.

Column 3,
Line 7, "serve" should read -- serves --.

Column 4,
Line 31, "cassettes" should read -- cassette --.

Column 8,
Line 2, "error in" should read -- an error in a --.
Line 64, "error in" should read -- an error in a --.

Column 9,
Line 9, "rotate" should read -- rotates --.
Line 21, "rotate" should read -- rotates --.

Signed and Sealed this

Third Day of September, 2002

*Attest:*

*Attesting Officer*

JAMES E. ROGAN
*Director of the United States Patent and Trademark Office*